US005082199A

United States Patent [19]

Oaks

[11] Patent Number: 5,082,199

[45] Date of Patent: Jan. 21, 1992

[54] DIGITAL ELECTRONICS ASSEMBLY FOR A TUBE-LAUNCHED MISSILE

[75] Inventor: Richard W. Oaks, Tucson, Ariz.

[73] Assignee: Hughes Aircraft Company, Los Angeles, Calif.

[21] Appl. No.: 384,228

[22] Filed: Jul. 21, 1989

[51] Int. Cl.[5] ..... F41G 7/00

[52] U.S. Cl. ..... 244/3.12; 244/3.11

[58] Field of Search ..... 244/3.11, 3.12, 3.13, 244/3.14, 3.21, 3.1

[56] References Cited

U.S. PATENT DOCUMENTS 4,037,202 7/1977 Terkian ..... 364/200
4,662,580 5/1987 Nelron ..... 244/3.21
4,732,349 3/1988 Maurer ..... 244/3.13
4,899,956 2/1990 King et al. ..... 244/3.21

*Primary Examiner*—Brian S. Steinberger
*Attorney, Agent, or Firm*—R. M. Heald; C. D. Brown; W. K. Denson-Low

[57] ABSTRACT

A digital electronics unit (81), missile, and missile system for a tube-launched missile. The invention utilizes a positional status mechanism (10) to structure signals from the on-board gyro system (80) and a directional mechanism (11) to separate signals from an operator. These signals are handled by a digital micro-controller (12) to create the proper control signals for manipulation of the missile in the missile system.

13 Claims, 5 Drawing Sheets

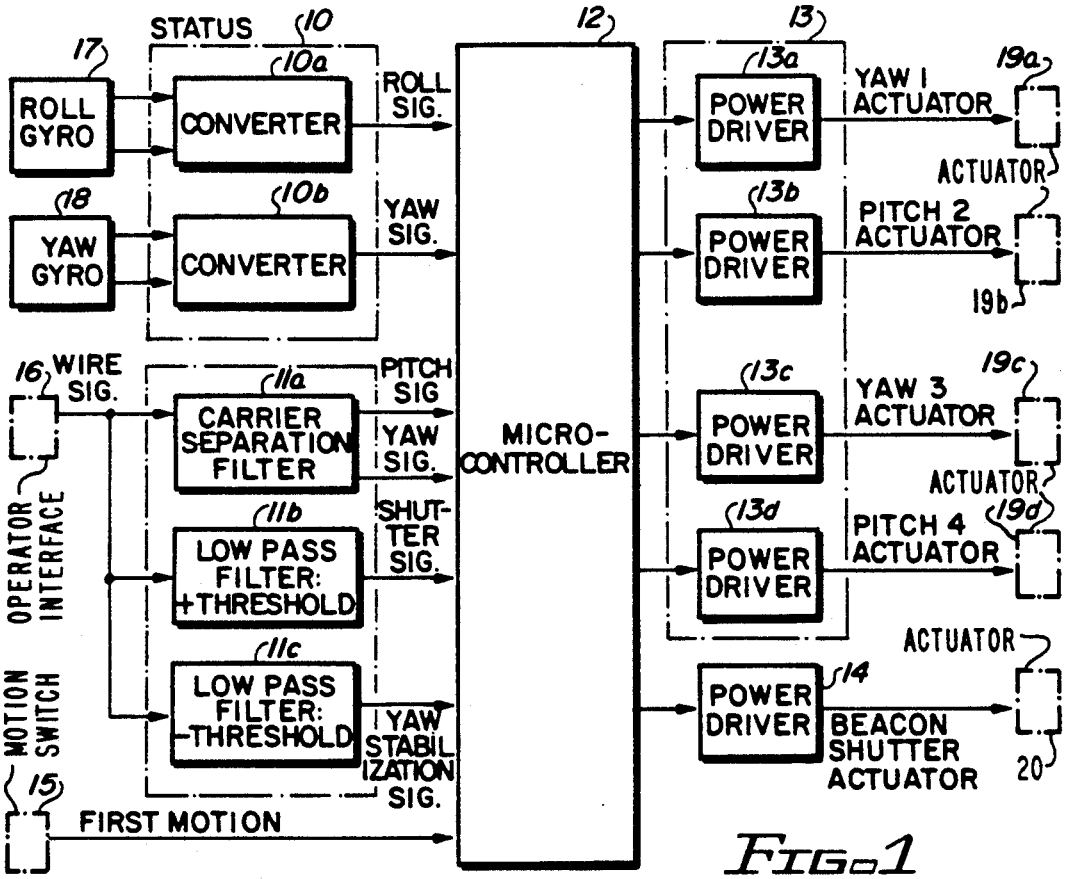
FIG. 1
FIG. 2
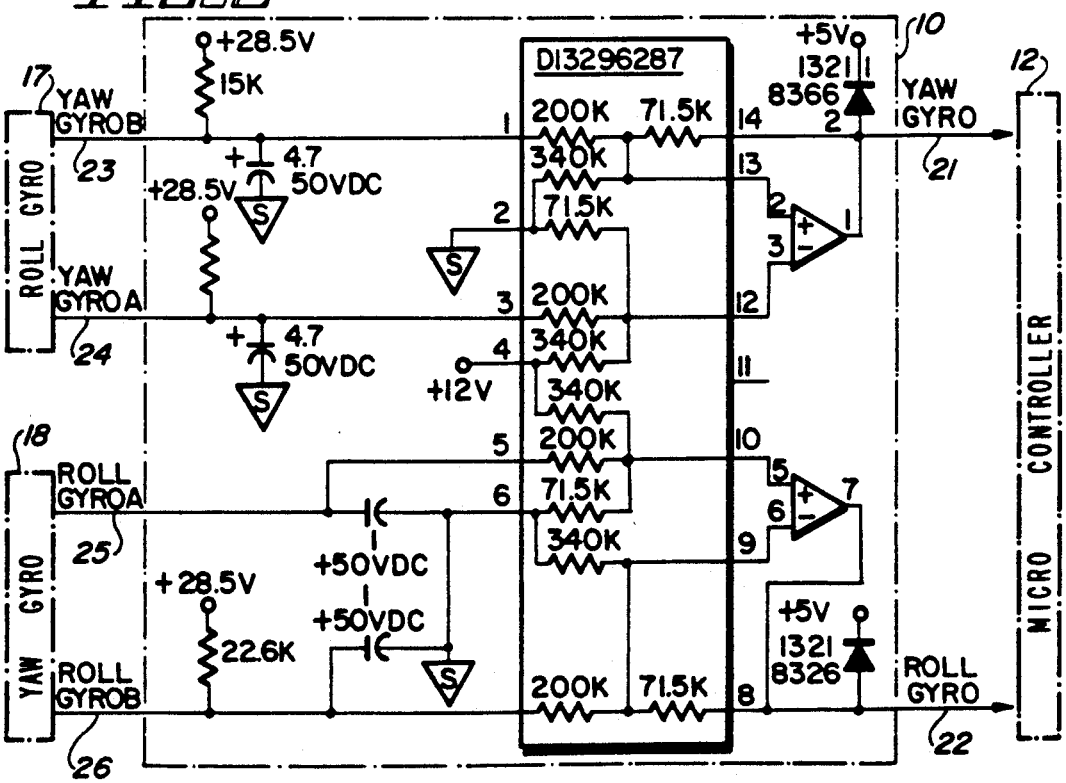

FIG. 5
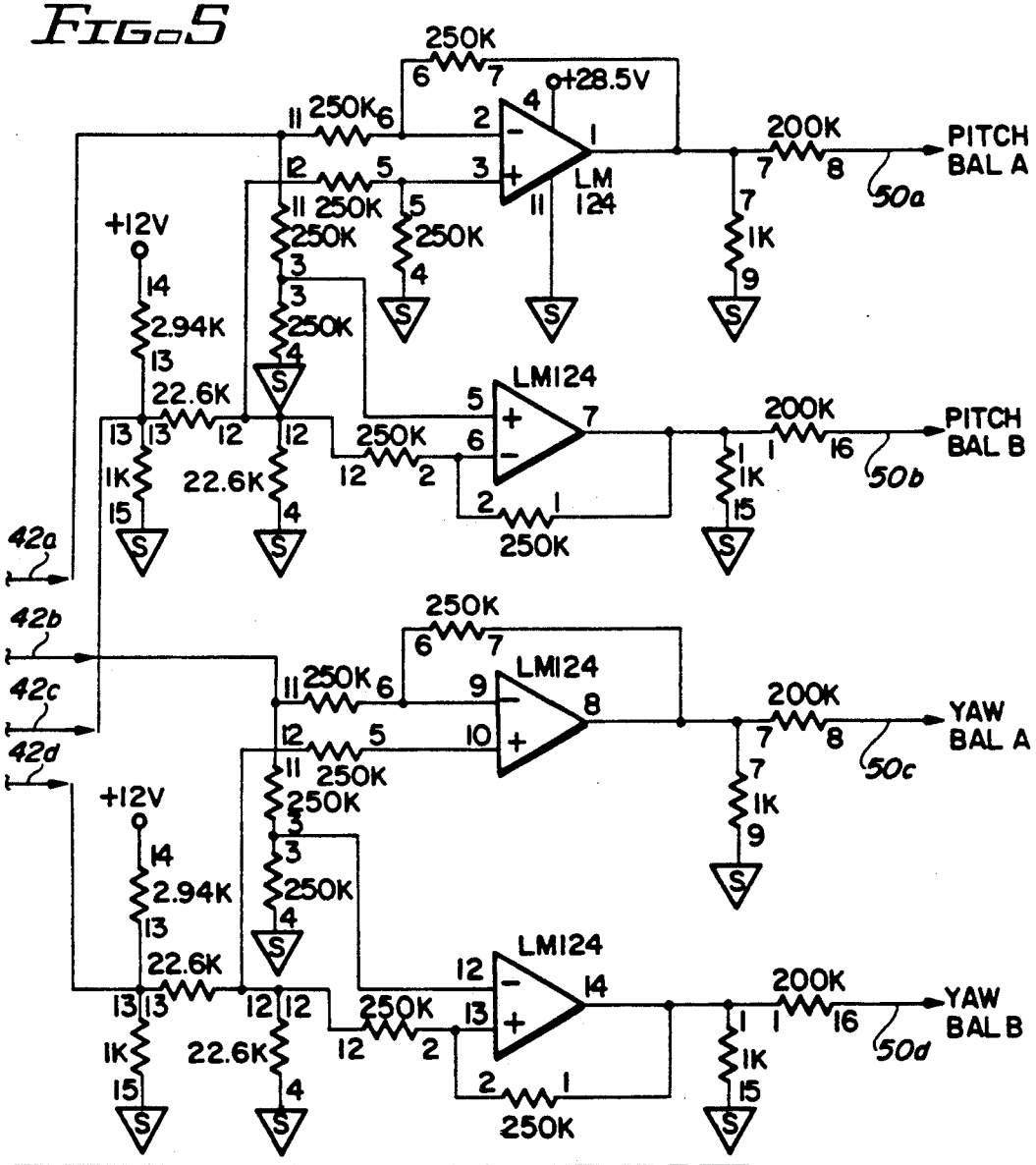
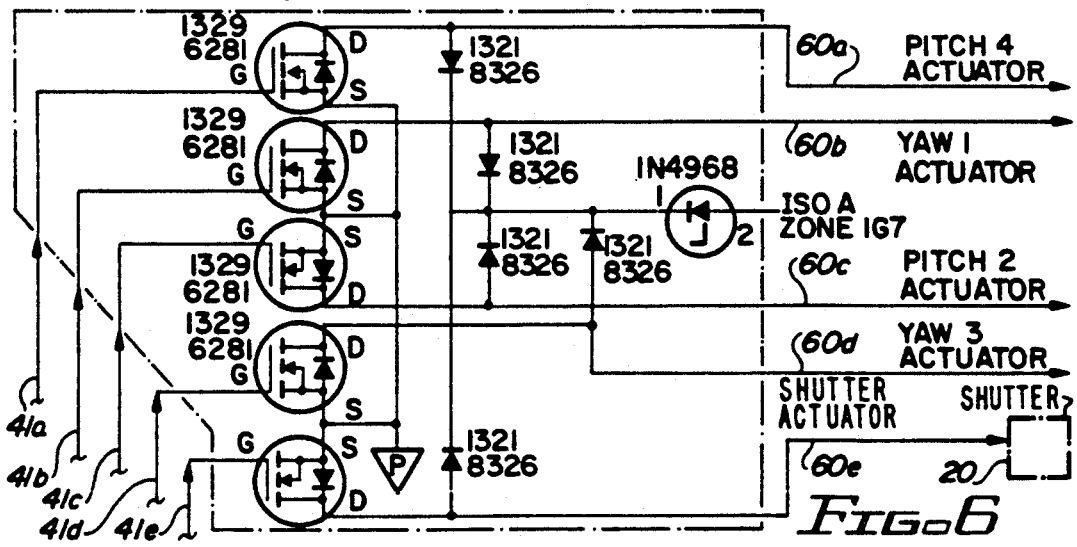
FIG. 6

DIGITAL ELECTRONICS ASSEMBLY FOR A TUBE-LAUNCHED MISSILE

RELATED INVENTIONS

Applicant acknowledges related application Ser. No. 07.384,229 filed July 21, 1989 and assigned to the assignee of the present invention.

BACKGROUND OF THE INVENTION

1. Field of the Invention

This invention relates generally to missiles and more particularly to tube-launched operator-guided missiles 2. Description of Related Art Tube-launched operator-guided missiles were first developed over a decade ago and have proven very effective against such targets as tanks, personnel carriers, bunkers, and the like.

A large part of these missiles' effectiveness and appeal is their simple operational concept. The operator of the missile "guides" the missile to the target. Communication with the missile is through a wire or fiber optic link. Using a telescope pointing mechanism, the operator controls the missile to avoid field obstructions such as trees or hills. Since the operator controls the line of flight, a great operational burden is removed from the missile itself, and the brains or complexity, required in other types of missiles, is reduced. This significantly reduces the cost of the missile.

As far as applicant is aware, these missiles currently receive the operator generated signals in analog form. The analog form is adequate for the communication of signals since the missile's electronic control unit utilizes changes in voltage in the communication link (a pair of thin steel lines) for providing the desired flight control.

Several problems attend the use of analog circuits. Where the incoming signal is analog, the electronics unit is also analog. However, being analog in nature, the electronics unit has been relative bulky and complex.

Another major difficulty with analog circuits, is that modification of the circuit's objective or operation is very difficult, requiring almost a total re-engineering of the circuit. Once a missile has been tested, even a slight control function change disrupts the layout of the entire analog circuit. This restraint inhibits the engineers from "fine tuning" the electronics unit.

The electronics unit implements the commands of the operator by adjusting the pitch and yaw control surfaces which guide the missile.

Another feature of these missiles is modularity. The various components making up these missiles (e.g. the warhead, the electronics unit, the flight motor, the launch motor, etc.) are unique and separate modules. This use of modules permits the missile to not only be maintained easily, but also allows it to be component upgraded without undue re-engineering of the entire system.

In this regard, the traditional design for tube-launched operator-guided missiles has placed the electronics unit directly behind the warhead in a forward position on the missile. Because of the bulk of the analog electronic unit, space is not available for the electronics unit aft.

Also, because of an overall length restriction, the bulky electronics unit limited the volume available for the warhead. For some targets, the limited size of the warhead is a disadvantage.

Still another disadvantage is with the electronics unit in a forward position, the balance of the missile is adversely affected. Compensating ballast is required in the aft section. This ballast only added to the weight considerations which required compensation in other areas (sometimes further reducing the warhead size).

It is clear from the forgoing that the present analog electronics unit creates many engineering problems which hinder the ready upgrade of tube-launched operator-guided missiles.

SUMMARY OF THE INVENTION

The present invention replaces the purely analog electronics unit with a hybrid analog/digital electronics unit. This hybrid electronics unit: permits not only easy modification of the electronics unit (through software changes to the digital micro-controller); but, also reduces the size of the electronics unit to such an extent that it fits into the aft section of the missile.

Movement of the electronics unit to the aft permits the warhead to be increased, reduces the need for aft ballast, and generally produces a more powerful missile.

The hybrid electronics unit of the present invention utilizes the analog signals from the operator together with the missile's own internal positional signals generated by the yaw and roll gyros to manipulate the yaw and pitch control surfaces.

Any subsequent engineering changes to the electronic "brains" are easily accomplished by simply modifying the internal software of the digital microprocessor.

BRIEF DESCRIPTION OF THE DRAWINGS

FIG. 1 is a functional block diagram of the preferred embodiment.

FIG. 2 is an electronic schematic of the positional status determination mechanism first described in FIG. 1.

FIG. 5 is an electronic schematic illustrating the handling of the signal used to control pitch and yaw.

FIG. 6 is an electronic schematic illustrating the handling of the signal used to control pitch and yaw and completing the objectives of the circuitry of FIG. 5.

DESCRIPTION OF THE PREFERRED EMBODIMENTS

Figure 3:
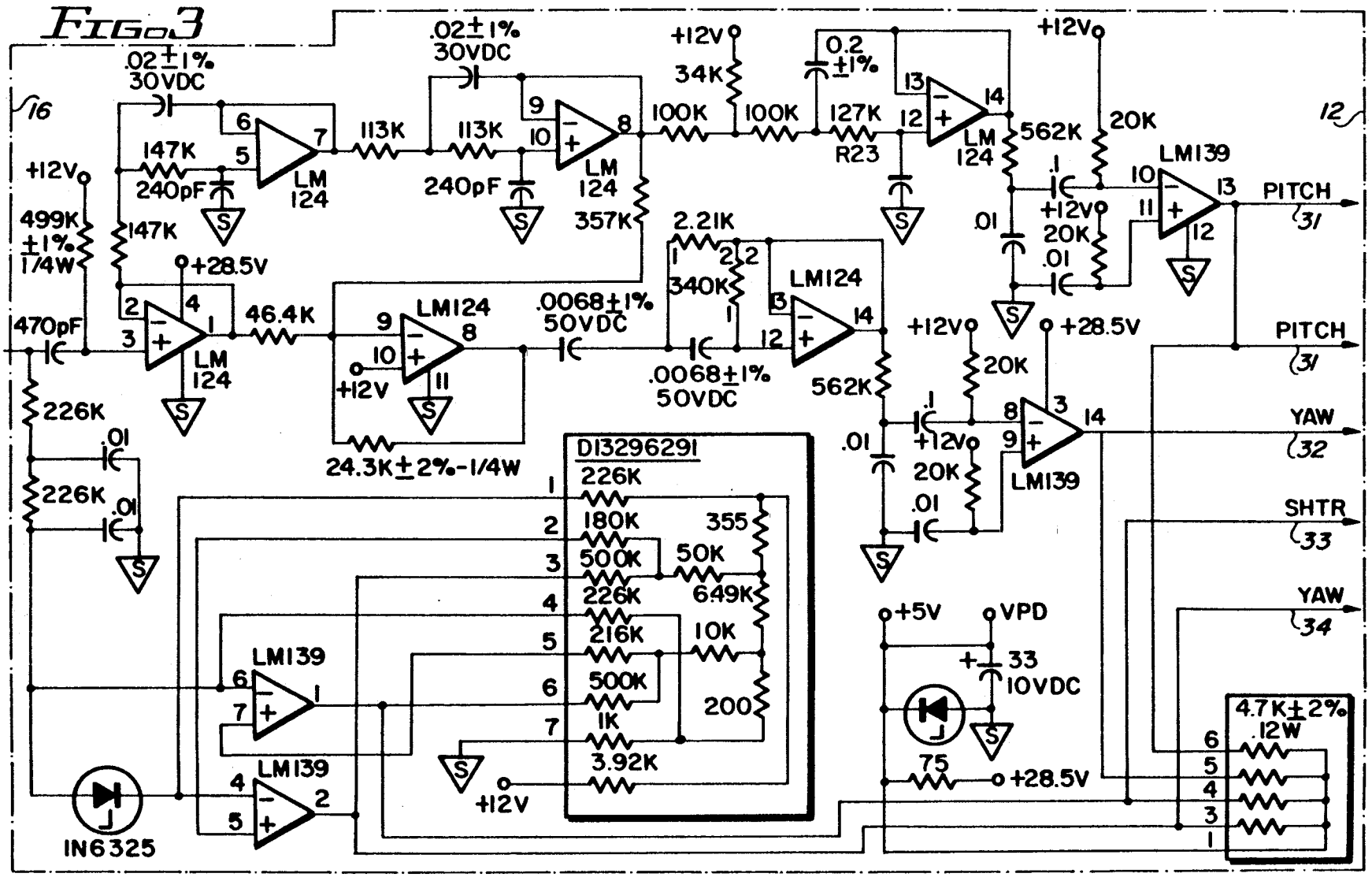
FIG. 3 is an electronic schematic of the decoding circuit for the operator generated signal first described in FIG. 1.

FIG. 1 illustrates, in block form, the operation of the preferred embodiment of this invention. At the center of the operation is the micro-controller 12. Utilizing it's software, the micro-controller 12 is the "brains" of the operation.

In this capacity, micro-controller 12 must be cognizant of the missile's positional status. This information is derived by utilizing the signals from roll gyro 17 and the yaw gyro 18. Positional status mechanism 10 utilizes these signals for the generation of the roll signal and the yaw signal which are used by the micro-controller 12.

This task is accomplished by taking the signal from the roll gyro 17 and converting it via converter 10*a* into the roll signal. Similarly, the signal from the yaw gyro 18 is converted via converter 10*b* into the yaw signal to be used by the micro-controller 12.

Information as to the operator's instructions/directions are communicated to the micro-controller 12 via the directional mechanism 11. The operator's directions are first translated by the missile launcher before being communicated to the missile. For purposes of this discussion, the translated signals are the operator's directions.

The operator feeds in the desired directions into operator interface 16. This directional information is communicated via a communication link (not shown) to the directional mechanism 11. The communication link is a continuous physical link (e.g. steel wire, copper wire, fiber optics, or the like) between the operator interface 16 and the missile.

Since the communication link is a single pair of wires, the signal from the operator must be broken into its component parts by the directional mechanism 11. This is accomplished by taking the incoming signal and passing it through a carrier separation filter 11*a* which generates the pitch signal and the yaw signal used by the micro-controller 12.

The shutter signal is obtained by the directional mechanism 11 through the use of a low pass filter with a positive threshold 11*b*. The shutter signal indicates that the operator desires to "close" the shutter on the be acon so that the location of the missile in flight can be visually obtained.

A low pass filter with negative threshold 11*c* obtains the yaw stabilization signal.

The final point of information required by the micro-controller 12 is obtained from the first motion switch 15. This switch 15 indicates when the missile has been launched so that the micro-controller 12 knows when manipulation of the missile is appropriate. Basically, the first motion signal initiates operation of the micro-controller 12.

Utilizing this information from the status mechanism 10 (roll signal and yaw signal), the directional mechanism 11 (pitch signal, yaw signal, shutter signal, and yaw stabilization signal), and the first motion switch 15 (first motion signal), the micro-controller 12 is capable of manipulating the missile through signals sent to the manipulation mechanism 13.

Manipulation mechanism 13 amplifies the signals from the micro-controller 12 and communicates the amplified signals to the proper control surface actuators. In the preferred embodiment, the actuators manipulate the control surfaces to affect the pitch and yaw of the missile in flight via the release of pressurized helium.

Operationally, the micro-controller 12 communicates four signals which pass through: power driver 13*a* to generate the Yaw 1 actuator signal manipulating actuator 19*a*; power driver 13*b* to generate the Pitch 2 actuator signal manipulating actuator 19*b*; power driver 13*c* to generate the Yaw 3 actuator signal manipulating actuator 19*c*; power driver 13*d* to generate the Pitch 4

FIG. 2 is an electronic schematic of the preferred embodiment of the status mechanism first described relative to FIG. 1.

Signals from the roll gyro 17 and the yaw gyro 18 are communicated to the circuit illustrated in FIG. 2, the positional status mechanism 10. Those of ordinary skill in the art readily recognize various gyros which may be used in this context.

The yaw gyro signal-A 23, the yaw gyro signal-B 24, the roll gyro signal-A 25, and the roll gyro signal-B 26, are manipulated and a yaw gyro signal 21 and roll gyro signal 22 is communicated to micro-controller 12.

FIG. 3 illustrates the preferred embodiment of the circuit used to create the directional mechanism 11. The directional mechanism 11 accepts the signals indicative of the operator's directions, from operator interface 16 (shown in FIG. 1).

The wire signals from the operator interface 16 are handled by three substantially independent circuits to establish the pitch signal 31 and the yaw signal 32, together with the shutter signal 33, and the yaw shorting signal 34. These four signals are communicated to micro-controller 12.

Figure 4A:
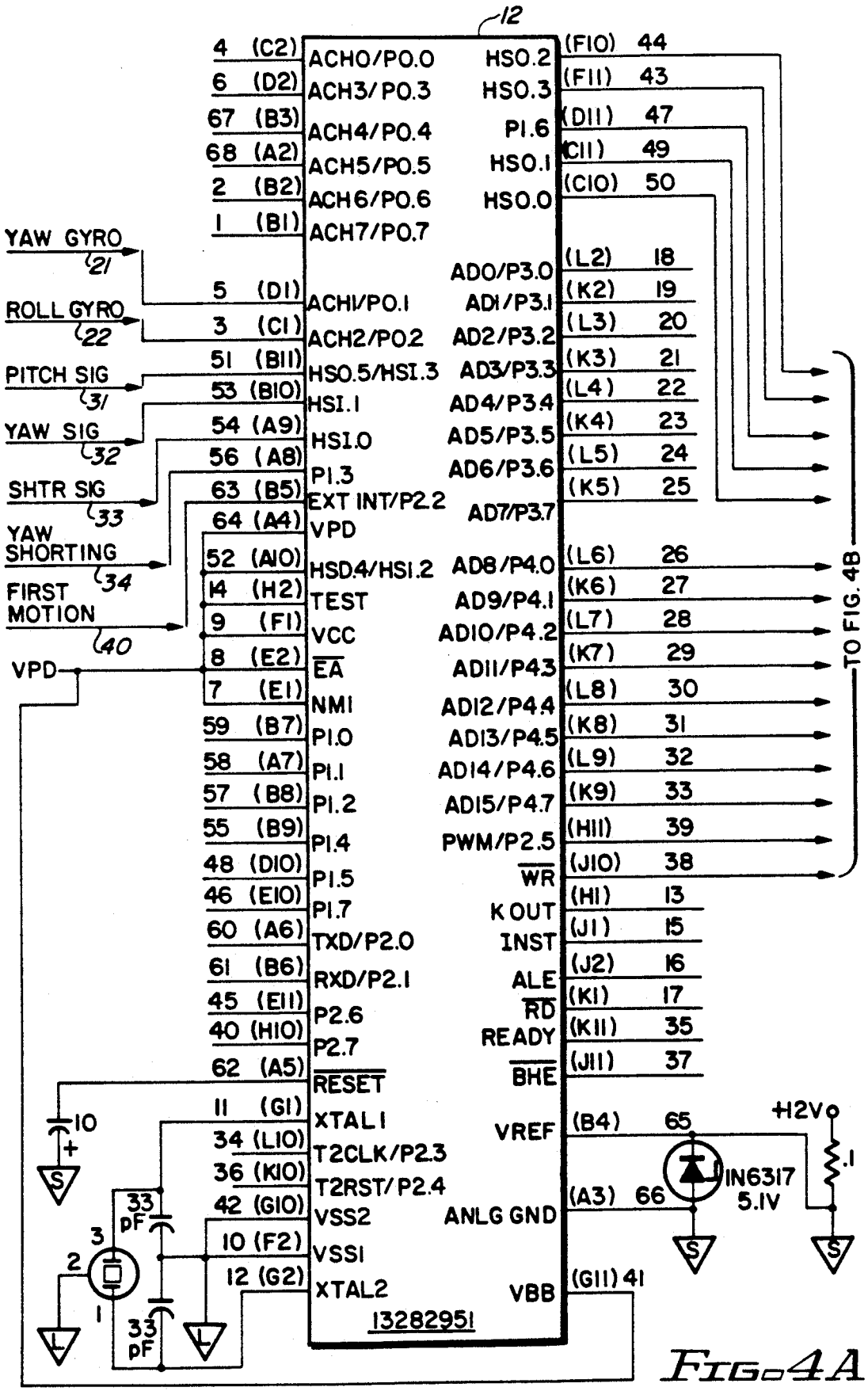
FIGS. 4*a* and 4*b* are wiring diagrams of the micro-controller first described in FIG. 1.
Figure 4B:
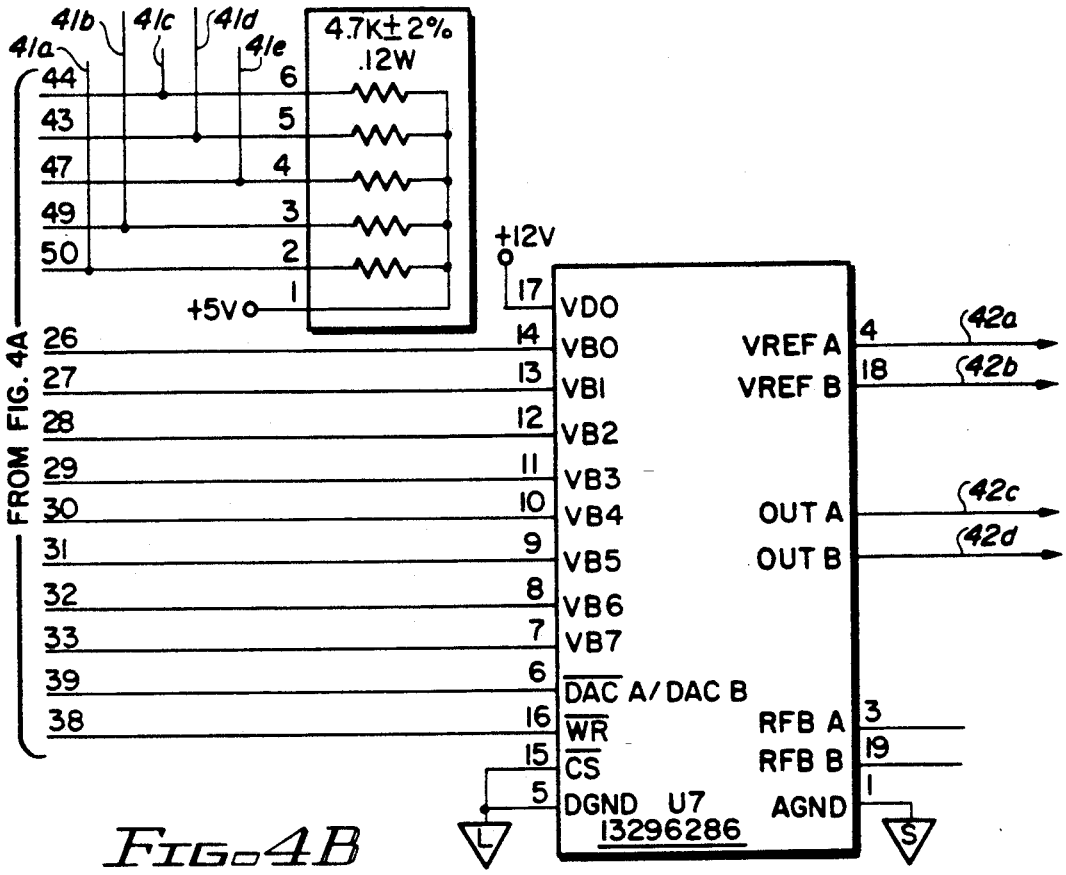
Figure 7:
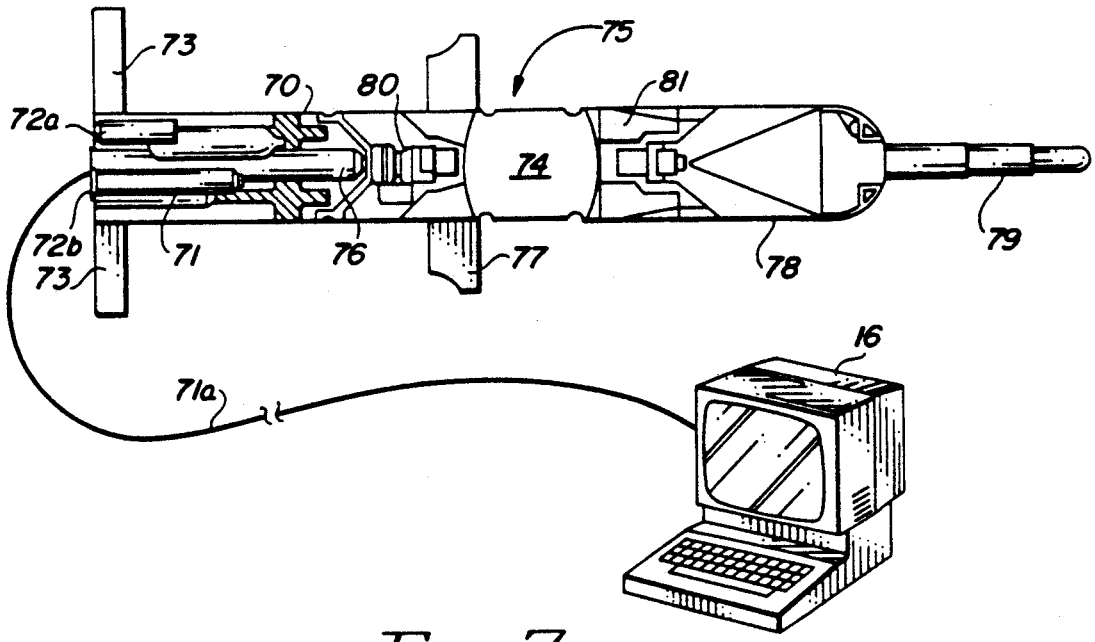
FIG. 7 is a cut-away view of an embodiment of the invention when implemented into a missile and a missile system.

FIGS. 4*a* and 4*b* illustrate the use of the signals from the positional status mechanism 10 and the directional mechanism 11 by the micro-controller 12. The yaw gyro signal 21 and the roll gyro signal 22 (as illustrated in FIG. 2), pitch signal 31, yaw signal 32, shutter signal 33, and yaw shorting signal 34 (as illustrated in FIG. 3) are combined with the first motion signal 40 within the micro-controller 12 to generate the control signals 41*a*, 41*b*, 41*c*, 41*d*, and 41*e*; also generated are control signals 42*a*, 42*b*, 42*c*, and 42*d*.

In this manner, the positional status of the missile is combined with the directions from the operator for proper manipulation of the missile in flight.

The first motion signal 40 is received from a switch and tells micro-controller 12 that the missile is in flight. It is at this time that control of the missile is feasible for the micro-controller 12.

In the preferred embodiment, the micro-controller 12 is a microprocessor, part number 8797 BH, commercially available from Intel Corporation. Stored within the micro-controller 12 is the software (described by the following Table A, Macro Assembly language for the Intel 8797 BH) to manipulate the incoming signals and perform the correct function with them.

actuator signal manipulating actuator 19*d*. These power drivers are the preferred mechanisms for the means for amplifying the signals.

In a similar manner, shutter 20 is manipulated by the micro-controller 12 through a signal which is amplified by power driver 14 creating the beacon shutter actuator signal.

In this manner, the objectives of the operator are quickly and easily translated into their proper sequence of missile manipulations.

TABLE A

```
_$1$DJA2:[FLOREZ]TOWVER4.001;1

$ SYMBOLS EP XREF PL(82) PW(128) TITLE("  Missile Tactical Software")

;    Missile Tactical Software ( MTS) version 4.1
;
; The following is a program listing of the  Missile Tactical Software.
; This program was written for the intel 8x97 microcontroller to be used in
; the     missile Digital Electronics Unit (DEU).  The program consists of
; a main routine, called INIT, and four interrupt service routines: HSI_D_A,
; AD_CONVR, SWTIM, and EXTRN.  A complete description of the functions this
; program performs can be found in the Computer Program Development Spec-
; ification (mis-39483) and in the Computer Program Product Specification
; (mis-39483).
;
;;;
```

```
        IOS1_IMAGE:          DSB    1    ; Image of IOS1 register                ;
        HSI_STATUS_IMAGE:    DSB    1    ; Image of HSI status register          ;
                                                                                  ;
        FLAGSET1:            DSB    1    ; Program status flags                  ;
;         bit 0  -  CVAC slope bit (0 = pos, 1 = neg) .                           ;
;         bit 1  -  big triangle bit (interpolation)                              ;
;         bit 2  -  balance sign bit (0 = pos, 1 = neg)                           ;
;         bit 3  -  yaw damping disable bit (0 = enable, 1 = disable)             ;
;         bit 4  -  yaw gyro sign bit (0 = pos, 1 = neg)                          ;
;         bit 5  -  roll gyro cal bit (0 = no calibration, 1 = calibrate)         ;
;         bit 6  -  yaw gyro cal bit (0 = no calibration, 1 = calibrate)          ;
;         bit 7  -  1st motion bit (0 = no 1st motion, 1 = 1st motion)            ;
                                                                                  ;
        FLAGSET2:            DSB    1    ; Program status flags                  ;
;         bit 0  -  pitch initial transition bit (0 = true, 1 = false)            ;
;         bit 1  -  yaw initial transition bit (0 = true, 1 = false)              ;
;         bit 2  -  first motion switch disable bit (0 = true, 1 = false)         ;
;         bit 3  -  More than 10 ms after power up bit (0 = false, 1 = true)      ;
                                                                                  ;
; General purpose scratch pad register area used by the HSI_D_A module            ;
        HSI_ACC:             DSL    3                                            ;
                                                                                  ;
; shared with variable that holds the interpolated time of CVAC zero crossing     ;
          INTRP_ZC_TIME      EQU    HSI_ACC            :word  ; (overlap)         ;
                                                                                  ;
; and with variable used to compute the time between pitch or yaw transitions     ;
          DELTA_T1           EQU    HSI_ACC+2          :word  ; (overlap)         ;
                                                                                  ;
; Pitch steering filter intermediate variables                                    ;
        PSDU1_IN:            DSL    1                                            ;
        PSDU2_IN:            DSL    1                                            ;
        PSDU3_OUT:           DSL    1                                            ;
        PSDU4_OUT:           DSL    1                                            ;
                                                                                  ;
; Yaw steering filter intermediate variables                                      ;
        YSDU1_IN:            DSL    1                                            ;
        YSDU2_IN:            DSL    1                                            ;
        YSDU3_OUT:           DSL    1                                            ;
        YSDU4_OUT:           DSL    1                                            ;
                                                                                  ;
; Pitch balance filter intermediate variables                                     ;
        PBDU1_IN:            DSL    1                                            ;
        PBDU2_IN:            DSL    1                                            ;
        PBDU3_IN:            DSL    1                                            ;
        PBDU4_IN:            DSL    1                                            ;
                                                                                  ;
; Yaw balance filter intermediate variables                                       ;
        YBDU1_IN:            DSL    1                                            ;
        YBDU2_IN:            DSL    1                                            ;
        YBDU3_IN:            DSL    1                                            ;
        YBDU4_IN:            DSL    1                                            ;
                                                                                  ;
; Pitch/Yaw steering and balance input and output variables                       ;
        P_S_UNDRDMP_IN:      DSL    1                                            ;
          P_FREQ_VALUE       EQU    P_S_UNDRDMP_IN     :long  ; (overlap)        ;
          Y_S_UNDRDMP_IN     EQU    P_S_UNDRDMP_IN     :long  ; (overlap)        ;
          Y_FREQ_VALUE       EQU    P_S_UNDRDMP_IN     :long  ; (overlap)        ;
        P_S_UNDRDMP_OUT:     DSL    1                                            ;
          Y_S_UNDRDMP_OUT    EQU    P_S_UNDRDMP_OUT    :long  ; (overlap)        ;
        P_B_OVRDMP_IN:       DSL    1                                            ;
          Y_B_OVRDMP_IN      EQU    P_B_OVRDMP_IN      :long  ; (overlap)        ;
        P_B_OVRDMP_OUT:      DSL    1                                            ;
          Y_B_OVRDMP_OUT     EQU    P_B_OVRDMP_OUT     :long  ; (overlap)        ;
        P_B_UNDRDMP_IN:      DSL    1                                            ;
          Y_B_UNDRDMP_IN     EQU    P_B_UNDRDMP_IN     :long  ; (overlap)        ;
        P_B_UNDRDMP_OUT:     DSL    1                                            ;
          Y_B_UNDRDMP_OUT    EQU    P_B_UNDRDMP_OUT    :long  ; (overlap)        ;
                                                                                  ;
; Variables used to hold the newest point (ordinate) along the CVAC signal        ;
        NEW_P2_ORD:          DSW    1                                            ;
          NEW_Y1_ORD         EQU    NEW_P2_ORD         :word  ; (overlap)        ;
        NEW_P4_ORD:          DSW    1                                            ;
          NEW_Y3_ORD         EQU    NEW_P4_ORD         :word  ; (overlap)        ;
                                                                                  ;
        NEW_TIME:            DSW    1    ; Used to hold the time the newest      ;
                                         ;  ordinate was sampled                  ;
                                                                                  ;
; Variables used to hold the times the previous ordinate was sampled              ;
        OLD_P_TIME:          DSW    1                                            ;
        OLD_Y_TIME:          DSW    1                                            ;
```

```
; Variables used to hold the previous point along the four CVAC signals
        OLD_P2_ORD:         DSW    1
        OLD_P4_ORD:         DSW    1
        OLD_Y1_ORD:         DSW    1
        OLD_Y3_ORD:         DSW    1

; Variables used to hold the center value of the four CVAC signals
        P2_CENTER:          DSW    1
        P4_CENTER:          DSW    1
        Y1_CENTER:          DSW    1
        Y3_CENTER:          DSW    1

; Variables used to compute the times the flipper commands are to be output
        P2_LATCH_TIME:      DSW    1
        P4_LATCH_TIME:      DSW    1
        Y1_LATCH_TIME:      DSW    1
        Y3_LATCH_TIME:      DSW    1
; shared with the variable used to time-out the first motion line
          F_M_COUNTER       EQU    Y3_LATCH_TIME     :word  ; (overlap)

        SHUTTER_IMAGE:      DSB    1    ; Image of the beacon shutter port
; shared with the variable used in outputing the software version number
          SOFT_VER_NUM      EQU    SHUTTER_IMAGE     :byte  ; (overlap)

        TIMER1_OVRFLW_CNT:  DSB    1   ; Used to keep count of clock overflows

; General purpose scratch pad register area used by the AD_CONVR module
        AD_ACC:             DSL    3
; shared with variables used to compute Roll and Yaw gyro calibration values
          R_CAL_ACC         EQU    AD_ACC            :word  ; (overlap)
          Y_CAL_ACC         EQU    AD_ACC+2          :word  ; (overlap)
          R_CAL_CNTR        EQU    AD_ACC+10         :byte  ; (overlap)
          Y_CAL_CNTR        EQU    AD_ACC+11         :byte  ; (overlap)

; Roll and Yaw gyro filter intermediate variables and,
        RGDU1_IN:           DSL    1
          YGDU1_IN          EQU    RGDU1_IN          :long  ; (overlap)
        RGDU2_IN:           DSL    1
          YGDU2_IN          EQU    RGDU2_IN          :long  ; (overlap)
; also used to hold the values read from the A/D converter
          RAW_AD_VALUE      EQU    RGDU2_IN          :word  ; (overlap)
          RAW_AD_VALUE_lo   EQU    RGDU2_IN          :byte  ; (overlap)
          RAW_AD_VALUE_hi   EQU    RGDU2_IN+1        :byte  ; (overlap)
        RGDU3_IN:           DSL    1
          YGDU3_IN          EQU    RGDU3_IN          :long  ; (overlap)

; Roll and Yaw gyro filter intermediate variables and,
        RGDU1_OUT:          DSL    1
        RGDU2_OUT:          DSL    1
        RGDU3_OUT:          DSL    1
        YGDU1_OUT:          DSL    1
        YGDU2_OUT:          DSL    1
        YGDU3_OUT:          DSL    1

        RGV:                DSW    1    ; Holds the roll into stering value
        YGV:                DSW    1    ; Holds the yaw into stering value

        AD_TIME_KEEPER:     DSW    1   ; Holds time of the last A/D conversion
; and also used to hold the time to output the software version number
          VER_NUM_TIME      EQU    AD_TIME_KEEPER    :word  ; (overlap)

        YDD_DELAY_CNT:      DSB    1    ; Used for yaw damping disable delay

        YDD_DELAY           SET    000BH    ;const ; 3.3ms per = 36ms

        INIT_F_M            SET    011EH    ;const ; 5.25us per = 1.5ms

        BALANCE_PORT        SET    6FFEH    :word  ; Balance DAC port

        CHIP_CONFIG_REG     SET    2018H    :byte  ; 8797 only

        SOFTWARE_VERSION    SET    3FFEH    :byte  ; Version number location

        VERSION_NUMBER      SET    0001H    ;const ; Production version number

        ;;;
```

```
;;;
```

```
bit3:
        BBC     SOFT_VER_NUM, 3, init_cont      ; Check bit 3
        LDB     HSO_COMMAND, #00100000B         ; Write bit 3 to flipper P4
        LD      HSO_TIME, VER_NUM_TIME          ;  at version number time

init_cont:
        LDB     HSO_COMMAND, #00011000B         ; Set software timer 0 to go
        SUB     HSO_TIME, TIMER1, #3D           ;  off in 130ms

init_variables:
        CLRB    TIMER1_OVRFLW_CNT               ; Initialize TIMER1 overflows

        LDB     YDD_DELAY_CNT, #YDD_DELAY       ; Initialize the Ydd delay count.

        LD      F_M_COUNTER, #INIT_F_M          ; Initialize first motion count.

        LD      P2_CENTER, #(32767D + 7951D)    ; 560Hz & 0 deg. equivalents
        LD      P4_CENTER, #(32767D - 7951D)    ;
        LD      Y1_CENTER, #(32767D - 2865D)    ; 870Hz & 0 deg. equivalents
        LD      Y3_CENTER, #(32767D + 2865D)    ;

        LD      OLD_P2_ORD, #42501D             ; Initialize old CVAC ordinates
        LD      OLD_P4_ORD, #42501D             ;  to maintain an up and right
        LD      OLD_Y1_ORD, #36500D             ;  steering command after 1st
        LD      OLD_Y3_ORD, #36500D             ;  motion until the launcher
                                                ;  issues a different command.

        LD      PSDU1_IN,   #0D                 ; Initialize steering filter
        LD      PSDU1_IN+2, #26776D             ;
        LD      PSDU2_IN,   #0D                 ;  delay units to zero error
        LD      PSDU2_IN+2, #30202D             ;
        LD      PSDU3_OUT,  #0D                 ;  average values.
        LD      PSDU3_OUT+2, #30996D            ;
        LD      PSDU4_OUT,  #0D                 ;
        LD      PSDU4_OUT+2, #3840D             ;
        LD      YSDU1_IN,   #0D                 ;
        LD      YSDU1_IN+2, #23884D             ;
        LD      YSDU2_IN,   #0D                 ;
        LD      YSDU2_IN+2, #28016D             ;
        LD      YSDU3_OUT,  #0D                 ;
        LD      YSDU3_OUT+2, #22213D            ;
        LD      YSDU4_OUT,  #0D                 ;
        LD      YSDU4_OUT+2, #7200D             ;

        LD      PBDU1_IN,   #0D                 ; Initialize balance filter
        LD      PBDU1_IN+2, #12458D             ;
        LD      PBDU2_IN,   #0D                 ;  delay units to zero error
        LD      PBDU2_IN+2, #8666D              ;
        LD      PBDU3_IN,   #0D                 ;  average values. (Pitch)
        LD      PBDU3_IN+2, #14775D             ;
        LD      PBDU4_IN,   #0D                 ;
        LD      PBDU4_IN+2, #7619D              ;

        LD      YBDU1_IN,   #0D                 ; Initialize balance filter
        LD      YBDU1_IN+2, #13377D             ;
        LD      YBDU2_IN,   #0D                 ;  delay units to zero error
        LD      YBDU2_IN+2, #10606D             ;
        LD      YBDU3_IN,   #0D                 ;  average values. (Yaw)
        LD      YBDU3_IN+2, #15096D             ;
        LD      YBDU4_IN,   #0D                 ;
        LD      YBDU4_IN+2, #9988D              ;

        LD      RGDU1_OUT,   #0D                ; Initialize gyro filter delay
        LD      RGDU1_OUT+2, #2806D             ;
        LD      RGDU2_OUT,   #0D                ;  units to zero error average
        LD      RGDU2_OUT+2, #16081D            ;
        LD      RGDU3_OUT,   #0D                ;  values.
        LD      RGDU3_OUT+2, #10280D            ;
        LD      YGDU1_OUT,   #0D                ;
        LD      YGDU1_OUT+2, #2336D             ;
        LD      YGDU2_OUT,   #0D
        LD      YGDU2_OUT+2, #15943D            ;
        LD      YGDU3_OUT,   #0D
        LD      YGDU3_OUT+2, #22827D            ;

        CLRB    R_CAL_CNTR                      ; For GYRO CALIBRATION
        CLRB    Y_CAL_CNTR                      ;

        LD      RGV, #7951D                     ; 0 deg. ROLL equivs.
        LD      YGV, #0                         ;
```

```
        LDB     AD_COMMAND, #00000010B          ; Command to start a ROLL A/D
        LDB     HSO_COMMAND, #00011111B         ;  conversion
        LD      AD_TIME_KEEPER, TIMER1          ; Start a conversion 131ms from
        LD      HSO_TIME, AD_TIME_KEEPER        ; now

                ; Now, enable interrupts.
        CLRB    INT_PENDING                     ; Clear any pending interrupts

flush_the_HSI_FIFO:
        LD      ZERO, HSI_TIME
        BBS     IOS1, 7, flush_the_HSI_FIFO

        LDB     INT_MASK, #10100110B            ; Mask off all but EXTINT, ST,
                                                ;  HSI_D_A, A/D CONV.

        EI
                ; All interrupts pull from the following idle loop.
idle_loop:
        BBC     FLAGSET1, 7, idle_loop    ; Check for 1st motion
        ANDB    INT_MASK, #01011111B      ; If found, mask EXTINT and ST
        BR      idle_loop
;;;
```

```
;;;
```

```
skip3:
        DIVU    HSI_ACC+4, DELTA_T1          ; Finds pitch frq. @ 2^6 lsb/Hz

        ;;;;;;;;   Extend the Pitch frequency to 32 bits   ;;;;;;;;;;;;;;;;;;;;
                                                                              ;
        LD      HSI_ACC+10, HSI_ACC+4        ; Transfer upper word            ;
                                                                              ;
        CMP     HSI_ACC+6, ZERO              ; Execute for zero remainder     ;
        BNE     p_32bit_extension            ;                                ;
        CLR     HSI_ACC+8                    ;                                ;
        BR      p_check_for_1st_motion       ;                                ;
p_32bit_extension:                                                            ;
        CLR     HSI_ACC                      ; Extend scaled filter (freq.)   ;
        NORML   HSI_ACC, HSI_ACC+8           ;  input to 32 bits by           ;
        SHL     HSI_ACC+6, HSI_ACC+8         ;  restoring the remainder.      ;
        CLR     HSI_ACC+4                    ;                                ;
        DIVU    HSI_ACC+4, HSI_ACC+2         ;                                ;
        LD      HSI_ACC+8, HSI_ACC+4         ;                                ;
                                                                              ;
        ;;;;;;;;;;;;;;;;;;;
```

```
;;;;;;;   Find 2nd 2 pole filter output Wc = 40 Hz, Zeta = 0.7  ;;;;;;;
                                                                        ;
MULU    HSI_ACC, HSI_ACC+4, #19913D     ; The offset deltaF becomes     ;
MULU    HSI_ACC+4, HSI_ACC+6, #19913D   ;  the filter input             ;
ADD     HSI_ACC+4, HSI_ACC+2                                            ;
ADDC    HSI_ACC+6, ZERO                 ; (19,913/65,536)*0.125 =       ;
SHRL    HSI_ACC+4, #3                   ;              0.03798027       ;
                                                                        ;
LD      P_B_UNDRDMP_IN, HSI_ACC+4       ; Save the underdamped input    ;
LD      P_B_UNDRDMP_IN+2, HSI_ACC+6     ;  for post-filter calcs.       ;
                                                                        ;
ADD     HSI_ACC+4, PBDU3_IN     ; This forms the underdamped output     ;
ADDC    HSI_ACC+6, PBDU3_IN+2   ;  ( = 4 pole filter output )           ;
                                                                        ;
LD      P_B_UNDRDMP_OUT, HSI_ACC+4      ; Save the underdamped output   ;
LD      P_B_UNDRDMP_OUT+2, HSI_ACC+6    ;  for post-filter calcs.       ;
SHLL    HSI_ACC+4, #1                   ; Scale up to 2^10              ;
                                                                        ;

;;;;;;;   Find the absolute value of deltaF   ;;;;;;;;;;;;;;;;;;;;;;;;;;
                                                                        ;
ANDB    FLAGSET1, #11111011B          ; Clear Balance sign bit (+)      ;
SUB     HSI_ACC+4, #37468D            ; Subtract 29.753488 Hz. (@ 2^10);
SUBC    HSI_ACC+6, #30467D            ;  offset to get deltaF (@ 2^10)  ;
                                                                        ;
BC      check_LO_CVAC                                                   ;
NOT     HSI_ACC+4                     ; Take the absolute value         ;
NOT     HSI_ACC+6                     ;  of deltaF and set bit          ;
ADD     HSI_ACC+4, #1                 ;                                 ;
ADDC    HSI_ACC+6, ZERO               ;                                 ;
ORB     FLAGSET1, #00000100B          ;                                 ;
                                                                        ;
check_LO_CVAC:                                                          ;
BBC     FLAGSET2, 2, check_HI_CVAC    ; Br if 1st motion switch enabled;
BBC     FLAGSET2, 3, check_HI_CVAC    ; Branch if time less than 10ms   ;
CMP     HSI_ACC+6, #10240D            ; Check if |deltaF| >= 10Hz @2^10;
BNC     hard_limit_pb_deltaF          ; Fail if deltaF < 10Hz           ;
BR      found_CVAC                                                      ;
                                                                        ;
check_HI_CVAC:                                                          ;
BBS     FLAGSET1, 2, hard_limit_pb_deltaF ; Fail if deltaF negative     ;
ORB     IOS1_IMAGE, IOS1              ; Get TIMER1 overflow status      ;
BBC     IOS1_IMAGE, 5, chk_time       ; Check if it overflowed          ;
INCB    TIMER1_OVRFLW_CNT             ; Inc count of TIMER1 overflows   ;
ANDB    IOS1_IMAGE, #11011111B        ; Clear TIMER1 overflow bit       ;
chk_time:                                                               ;
CMPB    TIMER1_OVRFLW_CNT, #4D        ; Check for 4*131ms ~.52sec       ;
BNC     hard_limit_pb_deltaF          ; Fail if less than .52 sec       ;
CMP     HSI_ACC+6, #15360D            ; Check if deltaF >= 15Hz @2^10   ;
BNC     hard_limit_pb_deltaF          ; Fail if deltaF < 15Hz           ;
                                                                        ;
found_CVAC:                                                             ;
CALL    CVAC_First_motion             ; CVAC signals first motion       ;

;;;;;;;;;;;;;;;   Hard-limit the error frequency   ;;;;;;;;;;;;;;;;;;;;
                                                                        ;
hard_limit_pb_deltaF:                                                   ;
CMP     HSI_ACC+6, #6336D             ; Check magnitude of deltaF       ;
BNC     scale_pb_deltaF                                                 ;
LD      HSI_ACC+6, #6336D             ; |deltaF| <  6.2 Hz  (@ 2^10)    ;
LD      HSI_ACC+4, ZERO                                                 ;

;;;;;;;   Convert deltaF to BALANCE code and output   ;;;;;;;;;;;;;;;;
scale_pb_deltaF:                                                        ;
MULU    HSI_ACC, HSI_ACC+4, #39140D     ; (39,140/65,536) * 2^5         ;
MULU    HSI_ACC+4, HSI_ACC+6, #39140D   ;   = 0.597222222 * 2^5         ;
ADD     HSI_ACC+4, HSI_ACC+2            ;   = 19.11111111               ;
ADDC    HSI_ACC+6, ZERO                 ; (deltaF) *.597222222 (@ 2^5);
                                                                        ;
SHLL    HSI_ACC+4, #3                   ; Multiply by 8 (@ 2^8)         ;
                                                                        ;
LD      HSI_ACC, #32768D                ; Load Balance center value     ;
                                        ;  128 (@ 2^8)                  ;
BBS     FLAGSET1, 2, neg_pb_deltaF                                      ;
SUB     HSI_ACC, HSI_ACC+6              ; Execute for +deltaF           ;
BC      form_pb_output_byte                                             ;
LD      HSI_ACC, ZERO                                                   ;
BR      form_pb_output_byte                                             ;
```

```
                                                                        ;
neg_pb_deltaF:                                                          ;
        ADD     HSI_ACC, HSI_ACC+6          ; Execute for -deltaF       ;
                                                                        ;
form_pb_output_byte:                                                    ;
        SHR     HSI_ACC, #8                 ; Scale down to 2^0         ;
        BNC     pb_output                                               ;
        INCB    HSI_ACC                     ; Round up if necessary     ;
pb_output:                                                              ;
        BBS     FLAGSET1, 7, p_chnl_strg    ; Skip after 1st motion     ;
        DI                                                              ;
        ANDB    IOPORT2, #11011111B         ; Select pitch channel (P2.5) ;
        LDB     BALANCE_IMAGE_W0+1, HSI_ACC ; Transfer high order byte. ;
        ST      BALANCE_IMAGE_W0, BALANCE_PORT ; Output the balance value ;
        EI                                                              ;
        BBC     FLAGSET1, 7, pitch_post_balance_calculations ; Skip steering ;
                                                             ; till 1st motion;

;;;;;;;;;;;;;;;;;;;;;;;;                    ;;;;;;;;;;;;;;;;;;;;;;;;;;;;;;
;;;;;;;;;;;;;;;;;;;;;;;;  Pitch channel steering  ;;;;;;;;;;;;;;;;;;;;;;;;;;;;;;
;;;;;;;;;;;;;;;;;;;;;;;;                    ;;;;;;;;;;;;;;;;;;;;;;;;;;;;;;

p_chnl_strg:

        ;;;;;;;;   Subtract off constant offset and scale up   ;;;;;;;;;;;;;;;;
                                                                        ;
        LD      HSI_ACC+8, P_FREQ_VALUE         ; Transfer to working   ;
        LD      HSI_ACC+10, P_FREQ_VALUE+2      ;  registers            ;
                                                                        ;
        SUB     HSI_ACC+8, #00000D              ;                       ;
        SUBC    HSI_ACC+10, #28160D             ; 28,160 = 440 Hz @ 2^6 ;
                                                                        ;

;   ********************   Execute the STEERING filter:   ************************
;   ************************      4 POLE 1 ZERO        ************************
;   ***  (2-1st ord. low pass cascaded with 2nd ord. underdamped low pass)  ***

        ;;;;;;;;;;;;;;   Scale the filter input for first stage  ;;;;;;;;;;;;;;
                                                                        ;
        MULU    HSI_ACC+4, HSI_ACC+8, #15662D   ; The offset deltaF becomes ;
        MULU    HSI_ACC+8, HSI_ACC+10, #15662D  ;  the filter input     ;
        ADD     HSI_ACC+8, HSI_ACC+6            ; (offset deltaF)*0.238978761 ;
        ADDC    HSI_ACC+10, ZERO                ;  scaled 2^6           ;

        ;;;;;;;;;;;;;;;;;;;;  1st order low pass Wp = 108 Hz  ;;;;;;;;;;;;;;;;;;
                                                                        ;
        ;;;;;;;;   First find PSDU4_IN   ;;;;;;;;;;;;;;;;;;;
```

```
;;;;;;;;   First find PSDU3_IN   ;;;;;;;;
```

```
        SUB     HSI_ACC+2, NEW_P2_ORD, OLD_P2_ORD     ; Determine slope        ;
        BE      P4_opposite_sign_test          ; No ZC if NEWP2ORD=OLDP2ORD  ;
        BNC     negative_P2_slope                                            ;
                                                                             ;
        SUB     HSI_ACC+6, NEW_P2_ORD, P2_CENTER                             ;
        BNH     P4_opposite_sign_test          ; fail if NEWP2ORD <= P2CTR   ;
        SUB     HSI_ACC+4, P2_CENTER, OLD_P2_ORD                             ;
        BNE     around1                                                      ;
        LD      INTRP_ZC_TIME, OLD_P_TIME                                    ;
        BR      P2_Output                                                    ;
around1:                                                                     ;
        BNC     P4_opposite_sign_test          ; fail if OLDP2ORD > P2CTR    ;
        BR      confirmed_P2_zero_crossing                                   ;
negative_P2_slope:                                                           ;
        ORB     FLAGSET1, #00000001B           ; Set slope bit (-slope)      ;
        SUB     HSI_ACC+6, P2_CENTER, NEW_P2_ORD                             ;
        BNH     P4_opposite_sign_test          ; fail if NEWP2ORD >= P2CTR   ;
        SUB     HSI_ACC+4, OLD_P2_ORD, P2_CENTER                             ;
        BNE     around2                                                      ;
        LD      INTRP_ZC_TIME, OLD_P_TIME                                    ;
        BR      P2_Output                                                    ;
around2:                                                                     ;
        BNC     P4_opposite_sign_test          ; fail if OLDP2ORD < P2CTR    ;
        NEG     HSI_ACC+2                                                    ;
                                                                             ;
        ;;;
```

```
        ;;;;;;;;      Check to see whether or not P4 has crossed        ;;;;;;;
        ;;;;;;;;   the "zero" axis by applying the opposite sign test   ;;;;;;;
        ;;;;;;;;     to the new P4 ordinate and the old P4 ordinate     ;;;;;;;
                                                                        ;
P4_opposite_sign_test:                                                  ;
        EI                                                              ;
        ANDB    FLAGSET1, #11111100B        ; Clear slope (+slope) and  ;
                                            ;  big triangle (big NEW) bits ;
        SUB     HSI_ACC+2, NEW_P4_ORD, OLD_P4_ORD   ; Determine slope   ;
        BE      p_strg_filter_calculations          ;     No ZC if      ;
        BNC     negative_P4_slope                   ;  NEWP4ORD=OLDP4ORD ;
                                                                        ;
        SUB     HSI_ACC+6, NEW_P4_ORD, P4_CENTER                        ;
        BNH     p_strg_filter_calculations          ; fail if NEWP4ORD <= P4CTR;
        SUB     HSI_ACC+4, P4_CENTER, OLD_P4_ORD                        ;
        BNE     around3                                                 ;
        LD      INTRP_ZC_TIME, OLD_P_TIME                               ;
        BR      P4_Output                                               ;
around3:                                                                ;
        BNC     p_strg_filter_calculations          ; fail if OLDP4ORD > P4CTR ;
        BR      confirmed_P4_zero_crossing                              ;
negative_P4_slope:                                                      ;
        ORB     FLAGSET1, #00000001B            ; Set slope bit (-slope) ;
        SUB     HSI_ACC+6, P4_CENTER, NEW_P4_ORD                        ;
        BNH     p_strg_filter_calculations      ; fail if NEWP4ORD >= P4CTR ;
        SUB     HSI_ACC+4, OLD_P4_ORD, P4_CENTER                        ;
        BNE     around4                                                 ;
        LD      INTRP_ZC_TIME, OLD_P_TIME                               ;
        BR      P4_Output                                               ;
around4:                                                                ;
        BNC     p_strg_filter_calculations      ; fail if OLDP4ORD < P4CTR ;
        NEG     HSI_ACC+2                                               ;
        ;;;;;;;;
```

```
        ADD     HSO_TIME, TIMER1, #3            ; If late, do it now
        BR      p_strg_filter_calculations
skip12:
        LD      HSO_TIME, P4_LATCH_TIME
        ;;;
```

```
        MULU    HSI_ACC, P_B_OVRDMP_IN, #41514D        ; (41,514/65,536)
        MULU    HSI_ACC+4, P_B_OVRDMP_IN+2, #41514D    ;   = 0.6334539
        ADD     HSI_ACC+4, HSI_ACC+2
        ADDC    HSI_ACC+6, ZERO

        ADD     PBDU2_IN, HSI_ACC+4            ; Add in the value from above
        ADDC    PBDU2_IN+2, HSI_ACC+6          ;  to get PBDU2_IN

        ;;;;;;;;   Now find PBDU3_IN   ;;;;;;;;
```

```
skip13:
        CMP     DELTA_T1, #526D                 ; Check the upper band limit ;
        BC      skip_14                         ;   ~950Hz                   ;
        LD      DELTA_T1, #526D                                              ;
skip_14:                                                                     ;
        CMP     DELTA_T1, #633D                 ; Check the lower band limit ;
        BNH     skip15                          ;   ~790Hz                   ;
        LD      DELTA_T1, #633D                                              ;
                                                                             ;
        ;;;
```

```
;;;;;;;   Find 1st 2 pole filter output Wc = 40 Hz, Zeta = 0.9   ;;;;;;;
                                                                        ;
ADD     HSI_ACC+4, YBDU1_IN     ; This forms the overdamped output      ;
ADDC    HSI_ACC+6, YBDU1_IN+2   ;  which goes into the underdamped fil.;
                                                                        ;
LD      Y_B_OVRDMP_OUT, HSI_ACC+4     ; Save the overdamped output      ;
LD      Y_B_OVRDMP_OUT+2, HSI_ACC+6   ;  for post-filter calcs.         ;
                                                                        ;


;;;;;;;   Find 2nd 2 pole filter output Wc = 40 Hz, Zeta = 0.7   ;;;;;;;
                                                                        ;
MULU    HSI_ACC, HSI_ACC+4, #18113D     ; (18,113/65,536)*0.0625 =      ;
MULU    HSI_ACC+4, HSI_ACC+6, #18113D   ;                .01727383      ;
ADD     HSI_ACC+4, HSI_ACC+2                                            ;
ADDC    HSI_ACC+6, ZERO                 ; This forms the underdamped    ;
SHRL    HSI_ACC+4, #4                   ;  filter input                 ;
                                                                        ;
LD      Y_B_UNDRDMP_IN, HSI_ACC+4       ; Save the underdamped input    ;
LD      Y_B_UNDRDMP_IN+2, HSI_ACC+6     ;  for post-filter calcs.       ;
                                                                        ;
ADD     HSI_ACC+4, YBDU3_IN     ; This forms the underdamped output     ;
ADDC    HSI_ACC+6, YBDU3_IN+2   ;  ( = 4 pole filter output )           ;
                                                                        ;
LD      Y_B_UNDRDMP_OUT, HSI_ACC+4      ; Save the underdamped output   ;
LD      Y_B_UNDRDMP_OUT+2, HSI_ACC+6    ;  for post-filter calcs.       ;
SHLL    HSI_ACC+4, #1                   ; Scale up to 2^10              ;
                                                                        ;

;;;;;;;;   Find the absolute value of deltaF   ;;;;;;;;;;;;;;;;;;;;;;;;;
                                                                        ;
ANDB    FLAGSET1, #11111011B          ; Clear Balance sign bit (+)      ;
SUB     HSI_ACC+4, #6350D             ; Subtract the 29.943454Hz @ 2^10;
SUBC    HSI_ACC+6, #30662D            ;  offset to get deltaF (@ 2^10)  ;
                                                                        ;
BC      hard_limit_yb_deltaF                                            ;
NOT     HSI_ACC+4                     ; Take the absolute value         ;
NOT     HSI_ACC+6                     ;  of deltaF and set bit          ;
ADD     HSI_ACC+4, #1                 ;                                 ;
ADDC    HSI_ACC+6, ZERO               ;                                 ;
ORB     FLAGSET1, #00000100B          ;                                 ;

;;;;;;;;;;;;;;;   Hard-limit the error frequency   ;;;;;;;;;;;;;;;;;;;;
                                                                        ;
                                                                        ;
hard_limit_yb_deltaF:                                                   ;
        CMP     HSI_ACC+6, #6336D             ; Check magnitude of deltaF ;
        BNC     scale_yb_deltaF                                         ;
        LD      HSI_ACC+6, #6336D        ; | deltaF |  <  6.2 Hz    (@ 2^10) ;

;;;;;;;;   Convert deltaF to BALANCE code and output   ;;;;;;;;;;;;;;;;
                                                                        ;
scale_yb_deltaF:                                                        ;
        MULU    HSI_ACC, HSI_ACC+4, #39140D     ; (39,140/65,536) * 2^5 ;
        MULU    HSI_ACC+4, HSI_ACC+6, #39140D   ;   = 0.597222222 * 2^5 ;
        ADD     HSI_ACC+4, HSI_ACC+2            ;   = 19.11111111       ;
        ADDC    HSI_ACC+6, ZERO                 ; (deltaF) *.597222222 (@ 2^5);
                                                                        ;
        SHLL    HSI_ACC+4, #3                   ; Mulitiply by 8 (@ 2^8) ;
                                                                        ;
        LD      HSI_ACC, #32768D                ; Load Balance center value ;
                                                ;  128 (@ 2^8)          ;
        BBS     FLAGSET1, 2, neg_yb_deltaF                              ;
        SUB     HSI_ACC, HSI_ACC+6              ; Execute for +deltaF   ;
        BC      form_yb_output_byte                                     ;
        LD      HSI_ACC, ZERO                                           ;
        BR      form_yb_output_byte                                     ;
                                                                        ;
neg_yb_deltaF:                                                          ;
        ADD     HSI_ACC, HSI_ACC+6            ; Execute for -deltaF     ;
                                                                        ;
form_yb_output_byte:                                                    ;
        SHR     HSI_ACC, #8                   ; Scale down to 2^0       ;
        BNC     yb_output                                               ;
        INCB    HSI_ACC                       ; Round up if necessary   ;
yb_output:                                                              ;
        BBS     FLAGSET1, 7, y_chnl_strg      ; Skip after 1st motion   ;
        DI                                                              ;
        ORB     IOPORT2, #00100000B           ; Select yaw channel (P2.5) ;
        LDB     BALANCE_IMAGE_W0+1, HSI_ACC   ; Transfer high order byte. ;
        ST      BALANCE_IMAGE_W0, BALANCE_PORT ; Output the balance value ;
```

```
        EI                                                                  ;
        BBC     FLAGSET1, 7, yav_post_balance_calculations ; Skip steering  ;
                                                           ; till 1st motion ;

;;;
```

```
        MULU    HSI_ACC, YSDU3_OUT, #44293D      ; (44,293/65,536)        ;    ;
        MULU    HSI_ACC+8, YSDU3_OUT+2, #44293D  ;      = 0.6758549908    ;    ;
        ADD     HSI_ACC+8, HSI_ACC+2                                      ;    ;
        ADDC    HSI_ACC+10, ZERO                 ;  0.6759 * YSDU3_OUT    ;    ;
                                                                          ;    ;
        SUB     HSI_ACC, HSI_ACC+4, HSI_ACC+8    ;                        ;    ;
        LD      HSI_ACC+2, HSI_ACC+6                                      ;    ;
        SUBC    HSI_ACC+2, HSI_ACC+10            ; Output @ 1.5 * 2^5     ;    ;
                                                                          ;    ;
        LD      YSDU3_OUT, HSI_ACC+4             ; Update YSDU3_OUT       ;    ;
        LD      YSDU3_OUT+2, HSI_ACC+6           ;  for next time         ;    ;
                                                                          ;
        ;;;
```

```
negative_YGV:
        SUB     NEW_Y1_ORD, YGV                 ; Exec. for negative YGV
        SUB     NEW_Y3_ORD, YGV                 ;


        ;;;;;;;;        Check to see whether or not Y1 has crossed        ;;;;;;;
        ;;;;;;;;    the "zero" axis by applying the opposite sign test    ;;;;;;;
        ;;;;;;;;      to the new Y1 ordinate and the old Y1 ordinate      ;;;;;;;

Y1_opposite_sign_test:
        ANDB    FLAGSET1, #11111100B            ; Clear slope (+slope) and
                                                ;  big triangle (big NEW) bits
        SUB     HSI_ACC+2, NEW_Y1_ORD, OLD_Y1_ORD       ; Determine slope
        BE      Y3_opposite_sign_test           ; No ZC if NEWY1ORD=OLDY1ORD
        BNC     negative_Y1_slope

        SUB     HSI_ACC+6, NEW_Y1_ORD, Y1_CENTER
        BNH     Y3_opposite_sign_test           ; fail if NEWY1ORD <= Y1CTR
        SUB     HSI_ACC+4, Y1_CENTER, OLD_Y1_ORD
        BNE     around5
        LD      INTRP_ZC_TIME, OLD_Y_TIME
        BR      Y1_Output
around5:
        BNC     Y3_opposite_sign_test           ; fail if OLDY1ORD > Y1CTR
        BR      confirmed_Y1_zero_crossing
negative_Y1_slope:
        ORB     FLAGSET1, #00000001B            ; Set slope bit (-slope)
        SUB     HSI_ACC+6, Y1_CENTER, NEW_Y1_ORD
        BNH     Y3_opposite_sign_test           ; fail if NEWY1ORD >= Y1CTR
        SUB     HSI_ACC+4, OLD_Y1_ORD, Y1_CENTER
        BNE     around6
        LD      INTRP_ZC_TIME, OLD_Y_TIME
        BR      Y1_Output
around6:
        BNC     Y3_opposite_sign_test           ; fail if OLDY1ORD < Y1CTR
        NEG     HSI_ACC+2

        ;;;;;;;;
```

```
skip19:                                                                 ;
        ADD     Y1_LATCH_TIME, INTRP_ZC_TIME, #1000D  ; Delay (2.0msec)  ;
                                                                        ;
        SUB     HSI_ACC, Y1_LATCH_TIME, #8D       ; Check if there is still ;
        SUB     HSI_ACC, TIMER1                   ;  time to set Y1 at the  ;
        BBC     HSI_ACC+1, 7, skip20              ;  desired time.          ;
        ADD     HSO_TIME, TIMER1, #3              ; If late, do it now      ;
        BR      Y3_opposite_sign_test                                     ;
skip20:                                                                 ;
        LD      HSO_TIME, Y1_LATCH_TIME                                   ;
                                                                        ;
        ;;;
```

```
Y3_Output:                                                                  ;
        DI                                                                  ;
        BBC     IOS0, 7, Y3_command                ; Check CAM-file holding ;
        EI                                         ;  register status       ;
        BR      Y3_Output                          ; Loop until free        ;
Y3_command:                                                                 ;
        LDB     HSO_COMMAND, #00100011B            ; Set Y3=1 (+slope)      ;
        BBC     FLAGSET1, 0, skip23                ; Slope bit              ;
        LDB     HSO_COMMAND, #00000011B            ; Clear Y3 (-slope)      ;
skip23:                                                                     ;
        ADD     Y3_LATCH_TIME, INTRP_ZC_TIME, #1000D  ; Delay (2.0msec)     ;
                                                                            ;
        SUB     HSI_ACC, Y3_LATCH_TIME, #8D      ; Check if there is still  ;
        SUB     HSI_ACC, TIMER1                  ;  time to set Y3 at the   ;
        BBC     HSI_ACC+1, 7, skip24             ;  desired time.           ;
        ADD     HSO_TIME, TIMER1, #3             ; If late, do it now       ;
        BR      y_strg_filter_calculations                                  ;
skip24:                                                                     ;
        LD      HSO_TIME, Y3_LATCH_TIME                                     ;
                                                                            ;
        ;;;
```

```
        MULU    HSI_ACC, Y_B_OVRDMP_IN, #16543D        ; (16,543/65,536)    ;  ;
        MULU    HSI_ACC+4, Y_B_OVRDMP_IN+2, #16543D    ;   = 0.252422       ;  ;
        ADD     HSI_ACC+4, HSI_ACC+2                                        ;  ;
        ADDC    HSI_ACC+6, ZERO                                             ;  ;
                                                                            ;  ;
        ADD     YBDU1_IN, HSI_ACC+4          ; Add in value from above      ;  ;
        ADDC    YBDU1_IN+2, HSI_ACC+6                                       ;  ;
                                                                            ;  ;
        SUB     YBDU1_IN, YBDU2_IN           ; Subtract YBDU2_IN from above ;  ;
        SUBC    YBDU1_IN+2, YBDU2_IN+2       ;  to get YBDU1_IN             ;  ;
                                                                            ;
        ;;;;;;;;   Now find YBDU2_IN   ;;;;;;;;
```

```
; filter.  After filtering the output is then rescaled and stored for
; future use with steering information in the HSI DATA AVAILABLE module.
;
; Before gyro filtering occurs the gyro input values must be calibrated.
; This is done in the gyro calibration routine at the end of this module.
; Sixteen samples on each channel (ROLL and YAW) are taken.  The average
; of these samples becomes the respective ROLL and YAW gyro center values
; to which the steering center values and the gyro filter intermediate
; values are tuned.
;
;;;
```

```
        ADD     AD_ACC+4, RGDU1_OUT                 ; Add in RGDU1_OUT
        ADDC    AD_ACC+6, RGDU1_OUT+2
        ADD     RGDU2_IN, RGDU1_IN, AD_ACC+4        ; Add in RGDU1_IN
        LD      RGDU2_IN+2, RGDU1_IN+2
        ADDC    RGDU2_IN+2, AD_ACC+6                ; RGDU2_IN complete!!!

;;;
```

```
        ;;;;;;;;   Update the state variables   ;;;;;;;;
```

```
        ADD     AD_ACC+4, YGDU1_OUT                 ; Add in YGDU1_OUT
        ADDC    AD_ACC+6, YGDU1_OUT+2
        ADD     YGDU2_IN, YGDU1_IN, AD_ACC+4        ; Add in YGDU1_IN
        LD      YGDU2_IN+2, YGDU1_IN+2
        ADDC    YGDU2_IN+2, AD_ACC+6                ; YGDU2_IN complete!!!

;;;
```

```
noYDD:                                                                  ;
        EI                                  ; Ready for steering        ;

        ;;;;;;;;   Update the state variables   ;;;;;;;;
```

```
        INCB    R_CAL_CNTR                      ; One more sample
        BR      chk_done_R_cal

default_ROLL_value:
        LD      R_CAL_ACC, #8184D               ; Load default value
        ANDB    FLAGSET1, #11011111B            ; Clear ROLL cal bit

chk_done_R_cal:
        CMPB    R_CAL_CNTR, #16D                ; Check for last value
        BC      cal_ROLL                        ;  (Branch if last value)
        BBS     FLAGSET1, 5, set_up_next_YAW_conv ; Check if done w/ ROLL gyro c

;   ************   Execute below when 16 samples have been collected   ********

cal_ROLL:
        ANDB    FLAGSET1, #11011111B            ; Clear ROLL cal bit
        MULU    AD_ACC+4, R_CAL_ACC, #63672D    ; Mult.by (63,672/65536)
                                                ;    = 15.54501693/16

        LD      RGV, AD_ACC+6                   ; Update RGV

        SUB     AD_ACC+6, #7951D                ; Sub. initial pitch RGV

        ;;;;;;;;   Calc. Pitch and Yaw steering center values   ;;;;;;;;;;;;;;;
                                                                            ;
        ADD     P2_CENTER, AD_ACC+6             ; Adjust pitch steering     ;
        SUB     P4_CENTER, AD_ACC+6             ;  center values            ;
                                                                            ;
        MULU    AD_ACC+4, R_CAL_ACC, #22941D    ; 22,941/65536=0.350055107  ;
                                                                            ;
        SUB     AD_ACC+6, #2865D                ; Sub. initial yaw RGV      ;
                                                                            ;
        SUB     Y1_CENTER, AD_ACC+6             ; Adjust yaw steering       ;
        ADD     Y3_CENTER, AD_ACC+6             ;  center values            ;


        ;;;;;;;;   Recalculate ROLL gyro filter intermediates   ;;;;;;;;;;;;;;;
                                                                            ;
        MULU    RGDU1_OUT, R_CAL_ACC, #22472D   ; Recalculate RGDU1_OUT     ;
                                                                            ;
        LD      RGDU2_OUT, RGDU1_OUT            ; Recalculate               ;
        LD      RGDU2_OUT+2, RGDU1_OUT+2        ;       RGDU2_OUT           ;
        SHLL    RGDU2_OUT, #3                   ;                           ;
        MULU    RGDU2_OUT, RGDU2_OUT+2, #46943D ;                           ;
                                                                            ;
        LD      RGDU3_OUT, RGDU2_OUT            ; Recalculate               ;
        LD      RGDU3_OUT+2, RGDU2_OUT+2        ;       RGDU3_OUT           ;
        MULU    RGDU3_OUT, RGDU3_OUT+2, #41895D ;                           ;

        ;;;;;;;;   Set up the next YAW gyro conversion   ;;;;;;;;;;;;;;;;;;;;;;
                                                                            ;
set_up_next_YAW_conv:                                                       ;
        BBS     IOS0, 6, set_up_next_YAW_conv   ; Loop until CAM is free    ;
                                                                            ;
        LDB     AD_COMMAND, #00000001B          ; Pgrm. A/D for yaw gyro    ;
        LDB     HSO_COMMAND, #00011111B         ; Command to start A/D      ;
        ADD     AD_TIME_KEEPER, TIMER1, #50D    ; 100 us from now.          ;
        LD      HSO_TIME, AD_TIME_KEEPER                                    ;

        POPF                                    ; Exit
        RET


;;;;;;;;;;;;;;;;;;;
```

```
        BBC     FLAGSET1, 6, set_up_next_ROLL_conv ; Check if done w/ YAW gyro ca
        CMPB    TIMER1_OVRFLW_CNT, #5              ; Check if still time for gyro
        BC      default_YAW_value                  ; Skip if not enough time

        LDB     RAW_AD_VALUE_lo, AD_RESULT_lo      ; Get A/D value
        LDB     RAW_AD_VALUE_hi, AD_RESULT_hi
        SHR     RAW_AD_VALUE, #6                   ; Shift out address bits

        CMP     RAW_AD_VALUE, #434D                ; Check if value is out of
        BNC     chk_done_Y_cal                     ;  range, if so then ignore
        CMP     RAW_AD_VALUE, #589D                ;  it. (Range +- 6.33 deg.)
        BH      chk_done_Y_cal                     ;  s.f. = 0.0818787 deg./bit

        ADD     Y_CAL_ACC, RAW_AD_VALUE            ; Add this to collection

        INCB    Y_CAL_CNTR                         ; One more sample
        BR      chk_done_Y_cal

default_YAW_value:
        LD      Y_CAL_ACC, #8184D                  ; Load default value
        ANDB    FLAGSET1, #10111111B               ; Clear YAW cal bit

chk_done_Y_cal:
        CMPB    Y_CAL_CNTR, #16D                   ; Check for last value
        BC      cal_YAW                            ;  (Branch if not last value)
        BBS     FLAGSET1, 6, set_up_next_ROLL_conv ; Check if done w/ YAW cal

;   ************   Execute below when 16 samples have been collected   ********

        ;;;;;;;;   Recalculate YAW gyro filter intermediates   ;;;;;;;;;;;;;;;;
                                                                              ;
.cal_YAW:
        ANDB    FLAGSET1, #10111111B               ; Clear YAW cal bit
        SHR     Y_CAL_ACC, #1                      ; Recalculate YGDU1_OUT    ;
        MULU    YGDU1_OUT, Y_CAL_ACC, #37413D      ;                          ;
                                                                              ;
        LD      YGDU2_OUT, YGDU1_OUT               ; Recalculate              ;
        LD      YGDU2_OUT+2, YGDU1_OUT+2           ;       YGDU2_OUT          ;
        SHLL    YGDU2_OUT, #3                      ;                          ;
        MULU    YGDU2_OUT, YGDU2_OUT+2, #55910D    ;                          ;
                                                                              ;
        LD      YGDU3_OUT, YGDU2_OUT               ; Recalculate              ;
        LD      YGDU3_OUT+2, YGDU2_OUT+2           ;       YGDU3_OUT          ;
        SHLL    YGDU3_OUT, #1                      ;                          ;
        MULU    YGDU3_OUT, YGDU3_OUT+2, #46917D    ;                          ;
                                                                              ;

        ;;;;;;;;   Set up the next ROLL gyro conversion   ;;;;;;;;;;;;;;;;;;;;
                                                                              ;
set_up_next_ROLL_conv:                                                        ;
        BBS     IOS0, 6, set_up_next_ROLL_conv     ; Loop until CAM is free   ;
                                                                              ;
        LDB     AD_COMMAND, #00000010B             ; Pgrm. A/D for roll gyro  ;
        LDB     HSO_COMMAND, #00011111B            ; Command to start A/D     ;
        ADD     AD_TIME_KEEPER, TIMER1, #50D       ; 100 us from now.         ;
        LD      HSO_TIME, AD_TIME_KEEPER                                      ;

        POPF                                       ; Exit
        RET


$ EJECT
$ TITLE("SOFTWARE TIMERS INTERRUPT SERVICE ROUTINE")
;SWTIM      MODULE
; This interrupt service routine is used to turn off the flipper power gates
; to allow external operation of the flippers during flipper allingment, or
; if the first motion switch was disabled at power up, this routine is used to
; set a bit to indicate 10 msec has passed since power up reset.
; This service routine is called once, either 10 or 130 msec after power up
; reset.
;
;;;;;;;;;;;;;;;;;;;
```

```
        ORB     IOS1_IMAGE, IOS1                    ; Get IOS1 status
        BBS     IOS1_IMAGE, 0, st0                  ; Check for soft timer0
check_bit1:
        BBS     IOS1_IMAGE, 1, st1                  ; Check for soft timer1

done:
        POPF
        RET

;;;;;;;;;;;;;;;;;   Software Timer 0: Flipper allingment  ;;;;;;;;;;;;;;;;;;;;

st0:
        LDB     HSO_COMMAND, #00000110B             ; Clear HSO.0 and HSO.1, turn
        ADD     HSO_TIME, TIMER1, #3                ;  off P4 and Y1 flippers.
        LDB     HSO_COMMAND, #00000111B             ; Clear HSO.2 and HSO.3, turn
        ADD     HSO_TIME, TIMER1, #3                ;  off P2 and Y3 flippers.
        ANDB    IOSI_IMAGE, #11111110B              ; Clear ST0 flag.
        BR      check_bit1

;;;;;;;;;;;;;;;;;   Software Timer 1:   Y1 Steering   ;;;;;;;;;;;;;;;;;;;;;;;;;
st1:
        ORB     FLAGSET2, #00001000B                ; Set 10 ms bit
        ANDB    IOS1_IMAGE, #11111101B              ; Clear ST1 flag.
        BR      done


$ EJECT
$ TITLE("EXTERNAL INTERRUPT SERVICE ROUTINE")
;EXTRN        MODULE
; This interrupt service routine senses the 1st motion signal ( defined
;  as a positive transition on the 1st motion input port pin (the external
;  interrupt line) and sets a bit to stop the self balance routine.
;
; It also clears the gyro calibration bits to stop gyro calibration if through
;  a fault calibration has not yet stopped.  Stopping calibration in this
;  way leaves the gyro filters and center values initialized for an average
;  gyro and gyro circuit combination.
;
; Finally, the routine sends an up and right steering command to the flippers.
;
; This module has a second entry point (CVAC_First_motion) which is used
;  when it is called as a subroutine by the HSI_D_A module.
;
;;;;;;;;;;;;;;;;;;;
```

```
        ST      BALANCE_IMAGE_W0, BALANCE_PORT  ; Init. pitch balance error
        ORB     IOPORT2, #00100000B             ; Select yaw balance (P2.5)
        ST      BALANCE_IMAGE_W0, BALANCE_PORT  ; Init. yaw balance error
        ORB     FLAGSET1, #10000000B            ; Set 1st motion bit

quick_exit:
        POPF
        RET


;;;
```

d) control means (12) being responsive to the yaw status signal, the roll status signal, the directional yaw signal, and the directional pitch signal, and generating therefrom, a primary yaw control signal, a secondary yaw control signal, a primary pitch control signal, and, a secondary pitch control signal; and, (e) means for generating a shutter direction signal based upon said operator generated signal.

2. The electronics unit according to claim 1, wherein said control means has means for generating a shutter control signal based upon said shutter direction signal.

3. The electronics unit according to claim 1 further comprising:

a) means for amplifying (13*a*) said primary yaw control signal;

b) means for amplifying (13*b*) said secondary yaw control signal;

c) means for amplifying (13*c*) said primary pitch control signal; and, d) means for amplifying (13*d*) said secondary pitch control signal.

4. The electronics unit according to claim 3 wherein said control means includes means for receiving a first motion signal and for generating the primary yaw control signal, the secondary yaw control signal, the primary pitch control signal, and the secondary pitch control signal.

5. The electronics control unit according to claim 1 further comprising:

a) means for amplifying (13*a*) said primary yaw control signal;

b) means for amplifying (13*b*) said secondary yaw control signal;

c) means for amplifying (13*c*) said primary pitch control signal; and, d) means for amplifying (13*d*) said secondary pitch control signal.

6. An operator guided missile being responsive to operator generated signals, said missile comprising:

a) a body portion (70) having, 1) a first pitch control surface (73), 2) a second pitch control surface, 3) a first yaw control surface, and, 4) a second yaw control surface;

b) a flight motor (74) located within said body portion and positioned for propelling said body portion;

c) a gyro system (80) mounted in said body portion and having, 1) a roll gyro (17) generating a roll gyro signal, and, 2) a yaw gyro (18) generating a yaw gyro signal; and, d) a communication link being a continuous physical connection (71*a*) between the operator and the guided missile, said communication link communicating said operator generated signals;

e) an electronics control unit (81) having, 1) positional determination means (10) having, a) a roll conversion means (10*a*) for converting the roll gyro signal to a roll status signal, and, b) a yaw conversion means (10*b*) for converting the yaw gyro signal to a yaw status signal, 2) directional means (11) being responsive to the operator generated signals received via said communication link and generating therefrom a directional pitch signal and a directional yaw signal, and, 3) control means (12) being responsive to the yaw status signal, the roll status signal, the directional yaw signal, and the directional pitch signal, and generating therefrom, a primary yaw control signal, a secondary yaw control signal, a primary pitch control signal, and, a secondary pitch control signal, 4) amplification means (13) having, a) means for amplifying (13*a*) said primary yaw control signal to an amplified primary yaw control signal, b) means for amplifying (13*b*) said secondary yaw control signal to an amplified secondary yaw control signal, c) means for amplifying (13*c*) said primary pitch control signal to an amplified primary pitch control signal, and, d) means for amplifying (13*d*) said secondary pitch control signal to an amplified secondary pitch control signal; and, f) means for manipulating the control surfaces having, 1) a first actuator (19*a*) being responsive to said amplified primary yaw signal for physical movement of said first yaw control surface, 2) a second actuator (19*b*) being responsive to said amplified primary pitch signal for physical movement of said first pitch control surface, 3) a third actuator (19*c*) being responsive to said amplified secondary yaw signal for physical movement of said second yaw control surface, and, 4) a fourth actuator (19*d*) being responsive to said amplified secondary pitch signal for physical movement of said second pitch control surface.

7. The operator guided missile according to claim 6 wherein said control means is digital.

8. The operator guided missile according to claim 7 further comprising a beacon (73*a*) and wherein said directional means has means for generating a shutter direction signal based upon said operator generated signal and wherein said control means has means for generating a shutter control signal based upon said shutter direction signal and which is communicated to said beacon.

9. The operator guided missile according to claim 8 further comprising a first motion switch (15) generating a first motion signal and wherein, upon receipt of said first motion signal by said control means, said control means initiates generation of the primary yaw control signal, the secondary yaw control signal, the primary pitch control signal, and the secondary pitch control signal.

10. An operator guided missile system comprising:

A) an operator input device (16) generating operator generated signals; and,

B) a missile having, 1) a body portion (70) having, a) a first pitch control surface (73), b) a second pitch control surface, c) a first yaw control surface, and, d) a second yaw control surface, 2) a flight motor (74) located within said body portion and positioned for propelling said body portion, 3) a gyro system (80) mounted in said body portion and having,
   a) a roll gyro (17) generating a roll gyro signal, and,
   b) a yaw gyro (18) generating a yaw gyro signal;
4) a communication link (71*a*) being a continuous physical connection between the operator input device and the missile for communicating said operator generated signals to the missile,
5) an electronics control unit (81) having,
   a) positional status determination means (10) having,
      1) a roll conversion means (10*a*) for converting the roll gyro signal to a roll status signal, and,
      2) a yaw conversion means (10*b*) for converting the yaw gyro signal to a yaw status signal,
   b) directional means (11) being responsive to the operator generated signals received via said communication link and generating therefrom a directional pitch signal and an directional yaw signal, and,
   c) control means (12) being responsive to the yaw status signal, the roll status signal, the directional yaw signal, and the directional pitch signal, for generating therefrom, a primary yaw control signal, a secondary yaw control signal, a primary pitch control signal, and, a secondary pitch control signal,
   d) amplification means (13) having,
      1) means for amplifying (13*a*) said primary yaw control signal to an amplified primary yaw control signal,
      2) means for amplifying (13*b*) said secondary yaw control signal to a secondary yaw control signal,
      3) means for amplifying (13*c*) said primary pitch control signal to an amplified primary pitch control signal, and,
      4) means for amplifying (13*d*) said secondary pitch control signal to an amplified secondary pitch control signal,
6) means for manipulating the control surfaces having,
   a) a first actuator (19*a*) being responsive to said amplified primary yaw signal for physical movement of said first yaw control surface,
   b) a second actuator (19*b*) being responsive to said amplified primary pitch signal for physical movement of said first pitch control surface,
   c) a third actuator (19*c*) being responsive to said amplified secondary yaw signal for physical movement of said second yaw control surface, and,
   d) a fourth actuator (19*d*) being responsive to said amplified secondary pitch signal for physical movement of said second pitch control surface.

11. The operator guided missile system according to claim 10 wherein said control means is digital.

12. The operator guided missile system according to claim 11 further comprising a beacon (73*a*) located on said missile and wherein said directional means has means for generating a shutter direction signal based upon said operator generated signal and wherein said control means has means for generating a shutter control signal based upon said shutter direction signal and which is communicated to said beacon.

13. The operator guided missile system according to claim 12 further comprising a first motion switch (15) generating a first motion signal and wherein, upon receipt of said first motion signal by said control means, said control means initiates generation of the primary yaw control signal, the secondary yaw control signal, the primary pitch control signal, and the secondary pitch control signal.

* * * * *

UNITED STATES PATENT AND TRADEMARK OFFICE

CERTIFICATE OF CORRECTION

PATENT NO. : 5,082,199

DATED : January 21, 1992

INVENTOR(S) : Richard W. Oaks

It is certified that error appears in the above-identified patent and that said Letters Patent is hereby corrected as shown below:

Column 3, line 59, insert:

--actuator signal manipulating actuator 19d. These power drivers are the preferred mechanisms for the means for amplifying the signals. In a similar manner, shutter 20 is manipulated by the micro-controller 12 through a signal which is amplified by power driver 14 creating the beacon shutter actuator signal.

In this manner, the objectives of the operator are quickly and easily translated into their proper sequence of missile manipulations.--

Column 4, lines 52-58, delete these lines.

Column 68, line 65, delete "an" and insert --a--.

Column 71, line 22, delete "an" and insert --a--.

Signed and Sealed this

Sixth Day of July, 1993

Michael K. Kirk

*Attest:*

MICHAEL K. KIRK

*Attesting Officer*

*Acting Commissioner of Patents and Trademarks*